United States Patent [19]

Pinero, deceased

[11] 3,975,872

[45] Aug. 24, 1976

[54] SYSTEM OF ARTICULATED PLANES

[76] Inventor: Emilio Perez Pinero, deceased, late of Calasparra (Murcia), Spain, by Consuelo Belda Aroca, legal heir

[22] Filed: Feb. 3, 1975

[21] Appl. No.: 546,634

Related U.S. Application Data

[63] Continuation-in-part of Ser. No. 314,722, Dec. 13, 1972.

[30] Foreign Application Priority Data

Dec. 14, 1971 Spain .....397,963

[52] U.S. Cl. ..... 52/71; 52/109; 52/641; 52/645

[51] Int. Cl.[2] ..... E04B 1/344

[58] Field of Search ..... 52/109, 641, 646, 645, 52/70, 71; 135/1

[56] References Cited

UNITED STATES PATENTS

| | | | |
|---|---|---|---|
| 2,803,317 | 8/1957 | Henderson | 52/641 |
| 3,152,347 | 10/1964 | Williams | 52/109 |
| 3,185,164 | 5/1965 | Pinero | 403/28 |
| 3,375,624 | 4/1968 | Mikulin | 52/109 |
| 3,557,500 | 1/1971 | Schmidt | 52/109 |
| 3,729,877 | 5/1973 | Hall | 52/109 |
| 3,771,274 | 11/1973 | Vaughan | 52/646 |
| 3,854,266 | 12/1974 | Salas | 52/71 |

*Primary Examiner*—Ernest R. Purser
*Assistant Examiner*—Henry Raduazo

[57] ABSTRACT

A system of articulated planes foldable from a planar configuration to a compact low-volume form. The structure is formed of a series of hinged planes, the planes having inwardly hinged joints at one edge and outwardly hinged joints at an opposite edge, such that the series of planes can be folded in the manner of the sides of an accordion bellows. A plurality of such articulated planes can be arranged in parallel fashion, such that the folds of the second series mesh with those of the first, the folds of the third series mesh with those of the second, etc. The hinges joining the planes are thus positioned in aligned rows transverse to the extent of the plane series and are dimensioned to accommodate the folding action. The hinges of each outside series have a broader span than the adjacent inner one. The inwardly hinge joint of a row are additionally hinged to alternate arms of a pantographic framework, the framework having a pair of cross arms for each series of planes, and a separate pantograhic framework provided for each row of inwardly hinged joints.

6 Claims, 16 Drawing Figures

SYSTEM OF ARTICULATED PLANES

CROSS-REFERENCE TO RELATED APPLICATION

This application is a Continuation-In-Part of copending application Ser. No. 314,722 filed Dec. 13, 1972.

BACKGROUND OF THE INVENTION

1. Field of the Invention

The present invention relates to a system of articulated planes foldable from a planar structure to a compact low-volume form, the novelty of which represents a substantial improvement over that which is known in the prior art.

The present invention applies to a variety of fields of art, and had utility as a decorative article, a portable wall, a reflecting structure, a platform, and a display structure. More generally, the invention can be used for applications requiring a relatively large planar surface area, but yet which can be folded to a compact form to facilitate storage, transportation, and handling.

2. Brief Description of the Prior Art

Attempts in the prior art to provide collapsible or folding two-dimensional surfaces have usually resulted in a foldable framework structure and separate demountable or removable flat plates or tiles. The two-dimensional surface is reconstructed by unfolding the framework to an expanded position and laying the separate tiles in position. While such devices are easy to store and to transport, they are difficult to handle because of the multiplicity of separate pieces and are difficult to assemble and disassemble. Additionally, the chances for losing any one of the large number of constitutent elements is great.

BRIEF SUMMARY OF THE INVENTION

Accordingly, an object of the present invention is to provide a system of articulated planes foldable from a flat planar structure to a compact low-volume form.

A further object of the invention is to provide such a foldable structure which does not require disassembly.

An additional object of the invention is to provide such a system of articulated planes, the two-dimensional planar surface of which can be increased in area by adding on to the basic structure.

In general terms, the system of articulated planes according to this invention comprises a series hinged planes in combination with a plurality of pantographic frameworks. The planes forming the series are aligned end-to-end and connected between planes by hinges. Each plane has an inwardly hinged joint at one of its edges and an outwardly hinged joint at an opposite edge, such that the series of planes can be folded in the manner of the sides of an accordion bellows. To produce a two-dimensional wall or support, a plurality of such plane series can be arranged in parallel fashion such that the second series of folds mesh with the first, the third series of folds mesh with the second, etc. in the folded state, and, upon extension of the pantographic frameworks, the system unfolds to form a flat planar two-dimensional surface. To accomplish this, the hinges joining the planes are positioned in aligned rows transverse to the extent of the plane series and are dimensioned to accomodate the folding action, i.e., the hinges of each outside series have a longer span than the adjacent inner one. The inwardly hinged joints of a row are additionally hinged to alternate arms of the pantographic framework, the framework having a pair of crossed arms for each series of planes, and a separate pantographic framework is provided for each row of inwardly hinged joints.

The system of articulated planes according to the present invention is foldable and unfoldable by the contraction and expansion, respectively, of a system of pantographic structutes. Accordingly, the invention is beneficially utilized with a known base structure which has nodes to which end pivot points of the pantographic structures can be secured and which themselves can be expanded and contracted in two-dimensions. A suitable base structure of this type can be found by reference to U.S. Pat. No. 3,185,164 showing a folding construction having exposed nodes all lying in a common plane but expandable in that plane. With this arrangement, the nodes of the base structure will remain in a common plane and equal distance from one another as the structure is expanded and contracted. Since the ends of the rod members forming the pantographic structure according to the present invention may be pivotally connected to the nodes, as the base structure is expanded the pantographic arms come to lie substantially parallel to the plane of the nodes, while in a fully contracted position of the base structure the pantographic arms are substantially perpendicular to the plane of the supporting nodes. Since the hinged edges of the planes are also pivotally connected to arms of the pantographic structure, the elemental planes also lie substantially parallel to the plane of the nodes in the expanded condition and substantially perpendicular to the plane of the nodes in the contracted position.

In accordance with that which has been stated above, it can be appreciated that the present invention can be utilized in any application requiring a flat smooth planar surface but which must be, or is desirable to be, foldable into a small volume. With proper means for sealing the unfolded edges of the planes (not shown), the structure could even be used for a roof to protect against rain and other climatic conditions.

BRIEF DESCRIPTION OF THE DRAWINGS

The invention will now be described in detail with reference to the accompying drawings representing preferred embodiments of the system of articulated planes. In the drawings.

Figure 6:
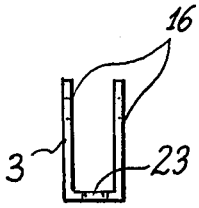
Figure 5:
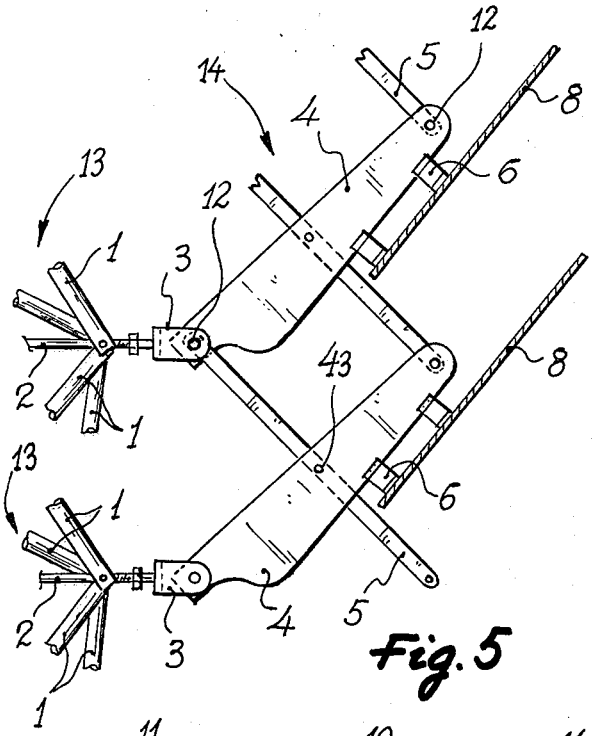

FIG.. 4 is a detailed view of the outer node of the basic support structure;

FIG. 5 is an elevation view of a pantographic framework in a partially expanded position;

FIG. 6 is an edge view of a bracket for pivotably mounting a pantographic framework to a node of the basic support structure.

Figure 7:
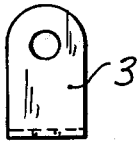
Figure 8:
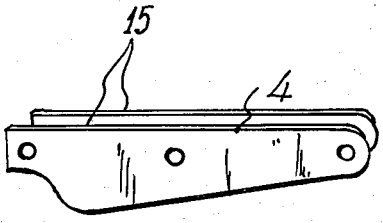
Figure 12:
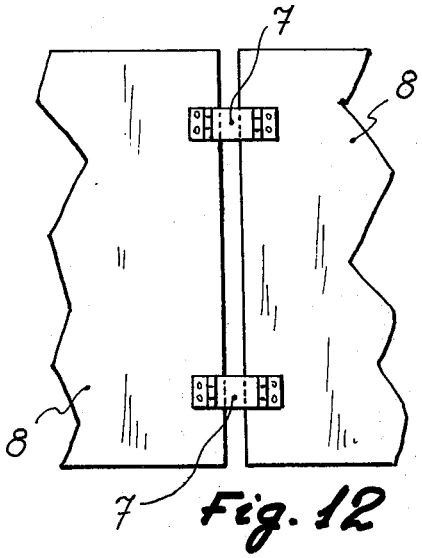
Figure 9:
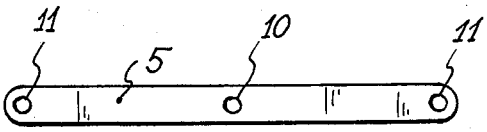
Figure 10:
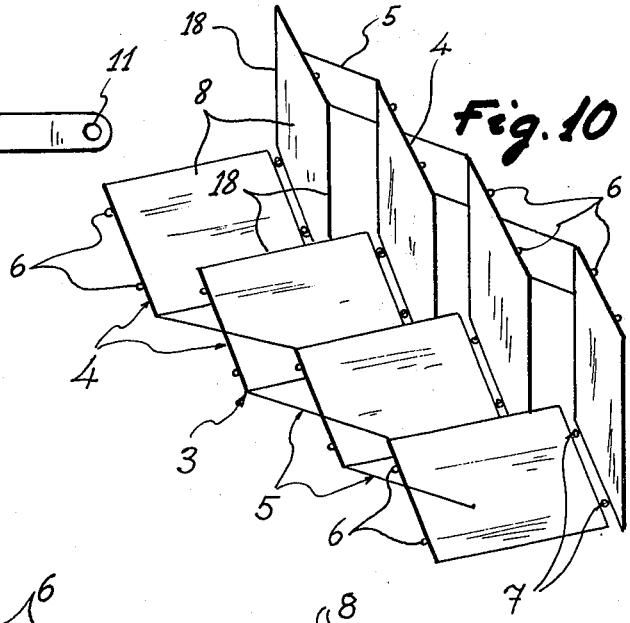
Figure 11:
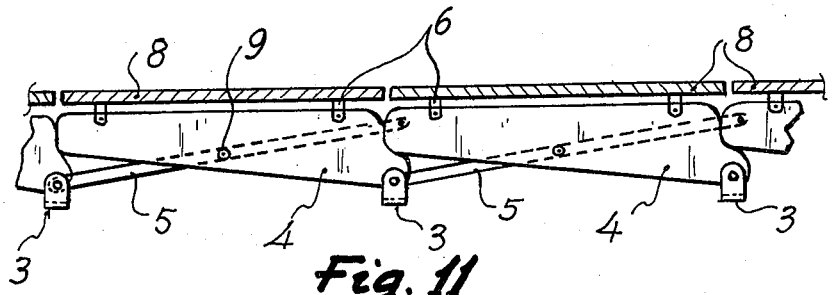
Figure 13:
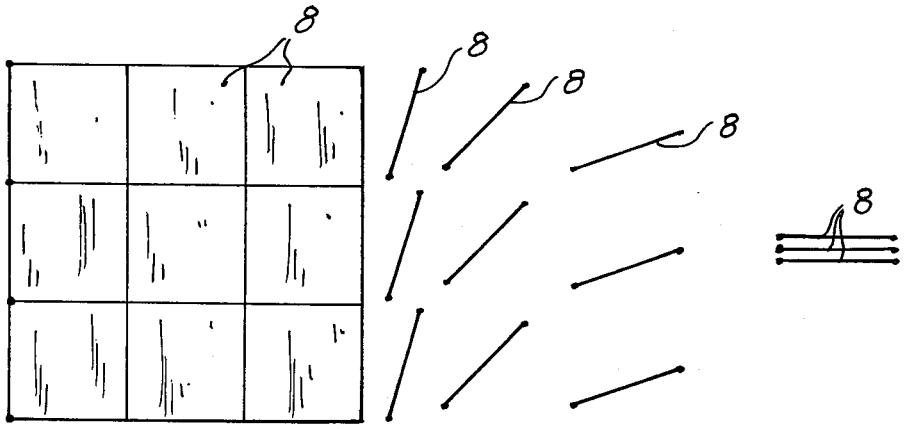
Figure 14:
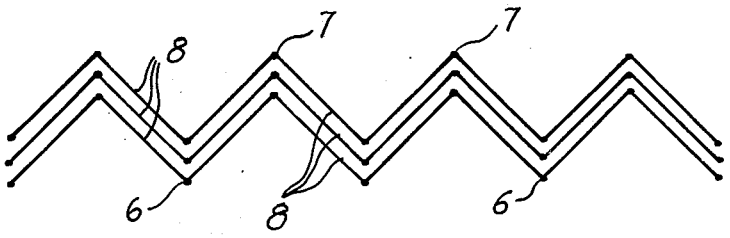
Figure 15:
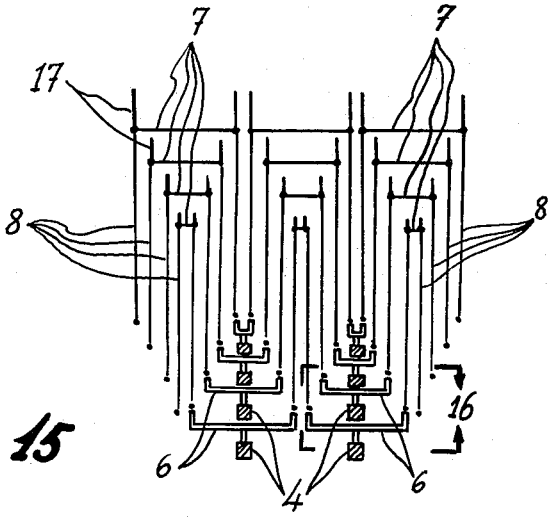
Figure 16:
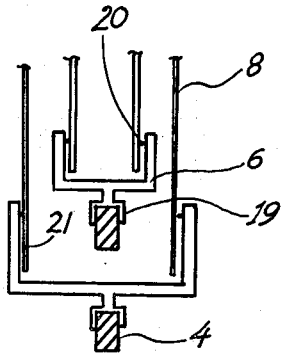

FIG. 7 is a side of the bracket of FIG. 6;

FIG. 8 is a perspective view of a pair of parallel arm plates comprising one of the cross arms of the pantographic framework;

FIG. 9 shows a connecting rod comprising one of the cross arms of the pantographic framework;

FIG. 10 is a schematic view of a partially expanded system of articulated planes;

FIG. 11 is a cross-sectional edge view of the system of planes showing the pantographic framework in a fully expanded position;

FIG. 12 details the hinge arrangement between adjacent planes;

FIG. 13 is a schematic representation showing the relative positions of the end planes of a simple nine structure as it is folded to a compact form;

FIG. 14 schematically shows the edge view of three series of planes in partially folded positions;

FIG. 15 schematically shows an ideal folded position for a system of many planes;

FIG. 16 show an expanded portion of the inwardly hinged edges of the planes.

DETAILED DESCRIPTION OF THE PREFERRED EMBODIMENT

Figure 1:
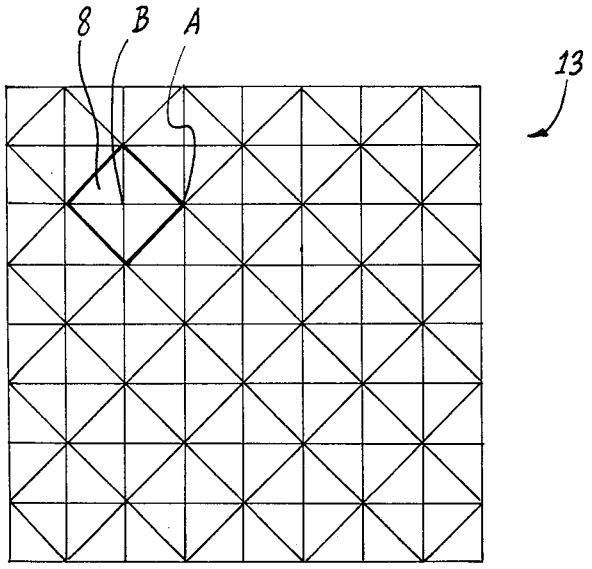
FIG. 1 is a schematic plan view of a folding base structure for supporting the system of articulated planes of this invention. This figure also shows schematically the relationship between a plane element of the invention and the underlying basic suport structure.
Figure 2:
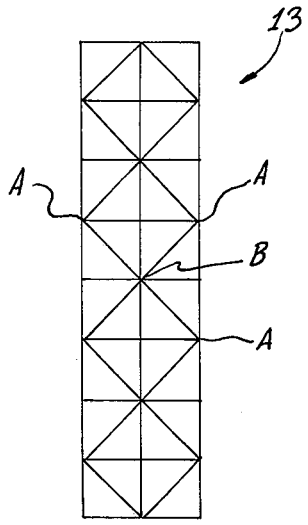
FIG. 2 is a side view of the structure of FIG. 1.

FIG. 1 shows schematically a plan view of a folding base or supporting structure 13 for the invention. The supporting structure may be similar in kind to that shown in U.S. Pat. No. 3,185,164 and comprises a succession of octahedrons, the verticies of which form outwardly projecting nodes for the structure, the nodes all lying in a common plane. This is better shown in FIG. 2 where all of the nodes A on the right side of the structure are in a common vertical plane. An opposing set of nodes A are formed on the rear of the structure (left side as seen in FIG. 2). The system of articulated planes are not restricted to but will normally be supported on only one side of the base supporting structure 13. The planes are preferably rectangular although other shapes may be used within the scope of this invention. The figures show square forms for the plates.

Figure 3:
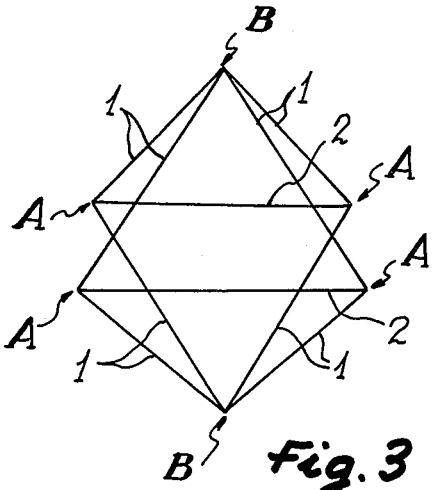
FIG. 3 is a schematic view of an octahedron segment of the supporting structure, positioned in a manner similar to that of FIG. 2.
Figure 4:
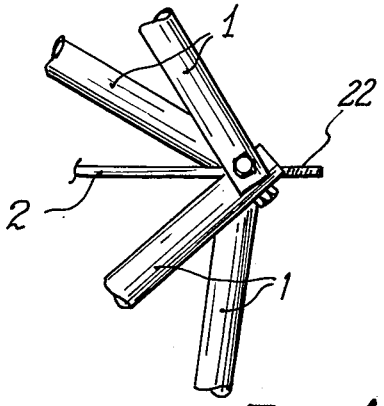

In FIG. 1, a matrix of planes B are shown in relationship to the supporting structure 13, the latter being formed by a plurality of rods 1 which are stiffened by stud elements 2, as may best be seen in FIG. 3 and 4. The octahedron shown in FIG. 3 is an ideal isolated octahedron, showing the rods 1 foreshortened for simplicity. In a matrix of octahedrons, rods 1 extend through pivot B to provide additional nodes as can be observed by reference to FIG. 2. Such an octahedral structure is known from U.S. Pat. No. 3,185,164. FIG. 3 in particular schematically depicts one of the octahedrons of FIG. 2 in a more detailed fashion. The supporting structure 13, without element 2, is collapsable, but when it is to be permanently positioned, elements 2 serve to give added strength to the expanded structure preventing the octahedral units from collapsing.

The manner in which the base structure 13 expands and contracts is fully explained in the aforementioned U.S. Pat. No. 3,185.164. The present invention is concerned with the provision of an expandable and contractable system of planes which can be attached to the nodes of the base structure, the combination then being capable of providing a large area planar surface and yet be collapsible to be portable, easy to handle, and easy to store.

With reference to FIG. 5, it will be noted that a pantographic framework 14 comprises a set of crossed pantographic arms 4 and 5. Each arm is pivoted near its center on a pin 43 which accomodates one slotted or forked pantographic arm 4 and one solid non-forked arm or rod 5. The ends of each pair of crossed pantographic arms are pivotally connected at joints 12 with another pair of pantographic arms 4 and 5 as best seen in FIG. 5. The fork arms 4 are comprised of a pair of arm plates 15 as shown in FIG. 8. The space between the plates is provided for insertion of rod 5 which slides between the two plates as the structure is expanded and contracted. This arrangement provides for alignment and sturdy and stable hinge action of the pantographic framework.

As best seen in FIG. 11, the forked arm plates 15 are substantially triangular and shaped in the form of a right triangle, one of the angles of which is blunted (the most acute angle seen in FIG. 11), the pivot points which connect with adjacent solid arms 5 being on a line parallel to the hypotenuse of the right triangle to permit, in the expanded position of said pantographic framework, the abuttment of blunted end against a detent in the short leg of the triangle of the adjacent forked arm 4, thereby to provide a solid support for the planes without subjecting the pivot points to excessive stress.

In FIG. 5 it will be noted that all of the pivot points along one edge of the pantographic framework are pivotally coupled to the nodes of the base structure 13 by means of U-shaped bracket elements 3. FIGS. 6 and 7 show the basic U-shaped element 3 which holds between its legs 16 the ends of one each of forked arms 4 and 5. The free ends of the pantographic arms 4 and 5 are, as mentioned above, pivotally connected to an adjacent arm pair.

As best seen in FIG. 10, the manner in which the system of planes can be folded may be easily understood by considering the plates as being formed by a set of dihedrons each comprising a pair of plates 8 and hinged together by outwardly hinged joints 7. In FIG. 10, each dihedron is shown having an angle of slightly more than 90° and is adapted to the folded one inside another, the most inner dihedron shown near the top part of FIG. 10 and the outer most dihedron shown near the bottom of FIG. 10. Since FIG. 10 is a schematic representation, the hinges 7 are not shown in detail. FIG. 12 shows the connection between plates 8 of hinges 7, and it will be noted that some length of hinge material spans the connection between the two plates 8. In actuality, hinge 7 is a double hinge having a joint on either side of the span. Hinges 7 also act as check pieces to limit the amount of opening of the two plates 8 to 180°. Many hinges of the type shown in FIG. 12 inherently limit the maximum opening angle of the panels upon which the hinge is mounted, and in the instant case, such limit is set at 180°. This is due to the edges of plates 8 hitting the span section of hinge 7, and could be implemented in other ways not shown. Obviously, in order for the dihedrons to collapse about one another, the hinges 7 near the bottom of FIG. 10 must have a greater span than adjacent ones, which in turn must have a greater span than the next one, and so on. This might be better understood by reference to FIG. 15 which shows schematically an increasing hinge length for the outer hinges.

In order that the unfolded structure will not have undesirable slots or gaps between plates, the hinges 7 are situated a predetermined distance from the ends of each plate so that the overhanging ends 17 of the plates 8 are greater for the longer length hinge 7.

Returning to FIG. 10, ignoring the pantographic framework 4, 5 for the moment, it can be appreciated that the dihedrons can be nested much like the pages of a phamplet or small book.

It can also be appreciated that if each dihedron were opened from a collapsed position and at the same time moved to line up the non-hinged edges 18 into planar form, with the hinges 7 all linearly aligned, a planar surface comprising 8 planes (referencing FIG. 10) will be produced.

The means by which the dihedrons are expanded to align edges 18 and likewise contracted to take a folded form is the pantographic framework 4, 5 which is shown to be attached to the edges of the plates opposite the plate edges coupled by hinges 7. Points 6 on the schematic of FIG. 10 indicate the positions of anchoring hinges which hinge the relevant plane edges to one of the pantographic arms (in examples shown forked arm 4). Clearly, if another set of dihedrons such as that shown in FIG. 10 were to connect at the set of anchor hinges 6, a large planar surface could be produced because of the increase in number of planes which can be folded and unfolded.

The manner in which the structure FIG. 10 can be enlarged will be appreciated by reference to FIG. 15 which shows a group of three sets of dihedrons, adjacent groups of dihedrons sharing common anchoring hinges 6 between each group. FIG. 15 also shows that each anchorage hinge 6 is attached to pantographic arm 4. In this respect, FIG. 16 is provided to show mounting portion 19 of each hinge 6, which mounting portion is welded, glued, or screwed to arm 4.

Additionally, FIG. 16 shows that, in order to avoid gaps between adjacent planes in the unfolded condition, pivot points 20 for the planes allow plane edges 21 to extend some distance beyond the hinge point 20. In this manner, when the planes of FIGS. 16 are in the expanded position, the ends of the two plates embraced by hinge 6 will abut one another.

FIG. 13 is intended to show the right hand edge of the nine plane example at the left of FIG. 13 as it is collapsed into folded form.

FIG. 14 is a more basic schematic of the arrangement of FIG. 15 indicating more generally how the plane pairs (dihedrons) fold upon one another like the sides of an accordion bellows.

The relationship between the two pantographic arms and the plurality of planes in a fully opened or unfolded position can be seen by reference to FIG. 11. FIG. 11 is essentially the same as the arrangement shown in FIG. 5 with the exception that FIG. 5 shows the system in partial expansion and planes 8 are situated on arms 4 in an offset relationship. The overhang of the planes fill the void left by the overhang of the adjacent plane.

With reference to the above discussion of the arrangement of FIG. 10, it can be appreciated that enlarging the size of the unfolded planar surface is a simple task, it being only necessary to attach additional pairs of plates to the existing set of dihedrons along the pantographic framework shown and/or additional dihedrons edgewise to those shown in FIG. 10 (attached at hinge points 6) and provide an additional pantographic framework for each dihedron group added.

From the foregoing, it can readily be realized that this invention can assume various embodiments. For example, the two crossed pantographic arms could be made to be identical in form and comprise simple straight rods. In such a case, an additional lateral projection might have to be added to one end of one of such arms in order to provide sufficient offset as is provided by the thickened edge of forked arm 4 near the point of connection with U-shaped bracket element 3. Thus, it is to be understood that the invention is not limited to the specific embodiment as described herein, but is to be limited only by the appended claims.

What is claimed is:

1. A system of folding planes comprising:

a first plurality of planes, each plane being substantially rectangular and having parallel and opposite first and second edges and parallel and opposite third and fourth edges, said planes forming a first series of plane members adapted to be folded from an expanded position lying in a common plane to a substantially parallel stacked position;

first hinge means comprising hinges coupling adjacent plane members in said first series together such that the first edge of each plane member is hinged to the second edge of an adjacent plane member in the series;

a second plurality of plane members similar to that of said first series and forming a second series of plane members;

second hinge means comprising hinges coupling adjacent plane members in said second series together such that the first edge of each plane member is hinged to the second edge of an adjacent plane member in the series;

at least one additional plurality of planes similar to that of said first series and forming at least one additional series of planes;

at least one additional hinge means comprising hinges coupling adjacent planes in said at least one additional series together such that the first edge of each plane is hinged to the second edge of an adjacent plane in the series;

a first pantographic framework having a plurality of crossed first and second arms, each of said first arms pivotally coupled at a first end to the third edge of a plane member in one series and coupled to a second end to the fourth edge of a plane member in an alternate series such that said first hinge means is aligned with said second hinge means in the direction of expansion and contraction of said pantographic framework;

a second pantographic framework having a plurality of crossed third and fourth arms, each of said third arms pivotally coupled at a first end to the third edge of a plane member in said one series and coupled at a second end to the fourth edge of a plane member in said alternate series, said first and second pantographic frameworks being spaced to connect to alternate hinges of each hinge means;

said pantographic crossed arms being pivotally connected together at their approximate centers, the ends of said arms being pivotally coupled to the ends of an adjacent pair of crossed arms;

wherein, when said pantographic frameworks are in expanded positions and said hinge means are in an open position, the plane members all lie in a common geometric plane with the first and second edges of adjacent plane members in each series abutting, and with the third edge of each plane member abutting the fourth edge of the plane member in an adjacent series, and wherein, when said pantographic frameworks are in contracted positions and said hinge means are in a closed position, the plane members of adjacent series lie substantially parallel to one another, with the plane members of each series nested in a substantially parallel stacked position in accordion-like fashion.

2. The system of claim 1, wherein said hinge means includes check pieces which limit the movement of the plane members of a plane pair to 180°.

3. The system of claim 1, wherein said arms comprise a slotted arm and a solid arm, the solid arm being sized to slidably fit in the slot of said slotted arm and move therein as said pantographic framework is expanded and contracted.

4. The system of claim 1, wherein said hinge means comprises a plurality of hinges of different dimension for each series of planes, the hinge of any series providing a smaller hinge span between planes than the hinges of the more outwardly adjacent series.

5. The system of claim 3, wherein said slotted arm comprises a pair of spaced parallel substantially triangular shaped plates in the form of a right triangle, one of the angles of which is blunted, the pivot points which connect with adjacent solid arms being on a line parallel to the hypotenuse of the right triangle to permit, in the expanded position of said pantographic framework, the abuttment of said blunted end against a detent in one leg of the adjacent slotted member, thereby to provide a solid support for the plane members it supports without subjecting the pivot points to excessive stress.

6. The system of claim 1, wherein each plane member is substantially square.

* * * * *